US008210735B2

(12) United States Patent
Choi

(10) Patent No.: US 8,210,735 B2
(45) Date of Patent: Jul. 3, 2012

(54) LIGHT EMITTING DIODE BULB

(75) Inventor: Woo Sun Choi, Gyeonggi-do (KR)

(73) Assignee: Kumho Electric Co., Ltd., Seoul (KR)

( * ) Notice: Subject to any disclaimer, the term of this patent is extended or adjusted under 35 U.S.C. 154(b) by 0 days.

(21) Appl. No.: 13/104,690

(22) Filed: May 10, 2011

(65) Prior Publication Data

US 2012/0019139 A1 Jan. 26, 2012

(30) Foreign Application Priority Data

Jul. 20, 2010 (KR) ..... 10-2010-0069949

(51) Int. Cl.
*H01R 33/00* (2006.01)

(52) U.S. Cl. ..... 362/650; 362/264; 362/373; 362/294; 362/800

(58) Field of Classification Search ..... 362/649–652, 362/657, 264
See application file for complete search history.

(56) References Cited

U.S. PATENT DOCUMENTS

| | | | | |
|---|---|---|---|---|
| 6,982,518 | B2 * | 1/2006 | Chou et al. | 313/46 |
| 7,628,513 | B2 * | 12/2009 | Chiu | 362/311.02 |
| 7,677,767 | B2 * | 3/2010 | Chyn | 362/294 |
| 2007/0236935 | A1 * | 10/2007 | Wang | 362/294 |
| 2008/0157112 | A1 * | 7/2008 | He et al. | 257/98 |
| 2008/0232119 | A1 * | 9/2008 | Ribarich | 362/373 |
| 2009/0175041 | A1 * | 7/2009 | Yuen et al. | 362/294 |
| 2010/0073944 | A1 * | 3/2010 | Chen | 362/373 |
| 2010/0219735 | A1 * | 9/2010 | Sakai et al. | 313/46 |
| 2010/0320892 | A1 * | 12/2010 | Yu | 313/46 |
| 2011/0050098 | A1 * | 3/2011 | Lenk et al. | 315/32 |

FOREIGN PATENT DOCUMENTS

| | | | |
|---|---|---|---|
| KR | 10-0937921 | B1 | 8/2009 |
| KR | 20-0446554 | * | 11/2009 |
| KR | 20-0446554 | Y1 | 11/2009 |
| KR | 10-0933990 | B1 | 12/2009 |

OTHER PUBLICATIONS

English language abstract of KR 10-0933990 B1.
English language abstract of KR 10-2009-0083002 A, the publication of KR 10-0937921 B1.
English language abstract of KR 20-0446554 Y1.

* cited by examiner

*Primary Examiner* — Jacob Y Choi
*Assistant Examiner* — Anthony Arpin
(74) *Attorney, Agent, or Firm* — Rabin & Berdo, P.C.

(57) ABSTRACT

An LED bulb includes an LED module having a PCB on which at least one LED element is mounted. A housing has a plurality of heat dissipating protrusions which protrude from an outer circumferential surface thereof, with a thread being formed on a predetermined portion of the housing. A light transmitting cover has a thread by which the cover can be fastened to the thread which is formed on the predetermined portion of the housing, in a threaded manner. Further, the LED bulb includes a bottom case into which an inverter for supplying a direct current to the LED module is inserted. The bottom case is inserted into the housing to be fastened to the housing. A socket is fastened to the bottom case.

5 Claims, 6 Drawing Sheets

LIGHT EMITTING DIODE BULB

CROSS-REFERENCE TO RELATED APPLICATION

This application claims priority under 35 USC 119 to Korean Patent Application No. 10-2010-0069949 filed Jul. 20, 2010. The disclosure of which is expressly incorporated by reference herein in its entirety.

BACKGROUND OF THE INVENTION

1. Technical Field

The present invention relates generally to an LED bulb and, more particularly, to an LED bulb, which is constructed so that a plurality of heat dissipating protrusions protrudes from the outer circumferential surface of a housing to increase the surface area of the housing, thus allowing heat generated from an LED element to be easily dissipated to the outside of the housing.

2. Background Art

Recently, lighting apparatuses that use a light emitting diode (hereinafter, referred to as an LED) to substitute for a fluorescent light have been subject to active development. The LED is advantageous in that the efficiency with which power is converted into light is excellent, the efficiency of light per unit power is high, its life span is long, power consumption is low, and high luminous intensity is obtained. Such LEDs have been used for a variety of purposes.

LED lights are advantageous because the processing speed is high and power consumption is low, whereas LED lights are disadvantageous because the light emitting part comprises a semiconductor element, so that it is more vulnerable to heat than are incandescent bulbs or fluorescent lights. That is, since LED lights are constructed so that a plurality of LED elements is mounted on an LED module, the amount of heat that is generated is large.

Especially, conventional LED bulbs are problematic in that the surface area of a housing is relatively small, and an additional heat dissipating structure is not provided, so that it is difficult to effectively dissipate heat emitted from an LED element. Hence, it is impossible to supply a predetermined or more of electric current to the LED element, so that a relatively large number of LED modules are required to use the LED element as a lighting apparatus.

Further, in the case of applying a cooling method to the LED bulb, there is a limitation in dissipating heat which is generated when the LED element is driven. In order to overcome the problem, the size of a heat dissipating member may be increased. This causes the size, weight, and cost of a product to increase, so that it is difficult to satisfy consumers.

Therefore, there is an urgent demand for the development of an LED bulb which can effectively dissipate the heat generated by an LED element while preventing the size, weight and cost of a product from increasing, thus fulfilling the desires of consumers.

SUMMARY OF THE INVENTION

Technical Problem

Accordingly, the present invention has been made keeping in mind the above problems occurring in the prior art, and an object of the present invention is to provide an LED bulb, which is constructed so that a plurality of heat dissipating protrusions protrudes from the outer circumferential surface of a housing to increase the surface area of the housing, thus enabling the heat generated by an LED element to be effectively dissipated.

Another object of the present invention is to provide an LED bulb, which is constructed so that a space defined in a bottom case of a housing is molded with a thermal conductive resin, thus improving the conductivity of heat generated from an LED element, therefore enabling heat to be easily transferred from the LED element to the housing.

A further object of the present invention is to provide an LED bulb, in which a housing and a light transmitting cover are constructed to be fastened to each other in a rotary locking manner, thus allowing the housing and the light transmitting cover to be fastened to each other in a simple manner.

Technical Solution

In order to accomplish the above objects, the present invention provides an LED bulb including an LED module having a PCB on which at least one LED element is mounted, a housing having a plurality of heat dissipating protrusions which protrude from an outer circumferential surface thereof, with a thread being formed on a predetermined portion of the housing, a light transmitting cover having a thread by which the cover can be fastened to the thread which is formed on the predetermined portion of the housing, in a threaded manner, a bottom case into which an inverter for supplying a direct current to the LED module is inserted, the bottom case being inserted into the housing to be fastened to the housing, and a socket fastened to the bottom case.

Further, the plurality of heat dissipating protrusions may be radially arranged on the outer circumferential surface of the housing in such a way as to protrude in a direction perpendicular to an axial direction of the housing.

Further, each of the heat dissipating protrusions may be tapered such that an area thereof increases in a direction from a lower portion to an upper portion of the housing.

Further, a space of the bottom case except for an area having the inverter may be molded with a thermal conductive resin.

Further, the inverter may be connected to the socket via an electrode wire, and may convert an alternating current, which is input from an outside through the socket, into a direct current, thus providing the direct current to the LED module.

Further, the bottom case may be fastened to the housing using a fastening screw.

Further, the housing may be made of at least one of aluminum and magnesium.

Further, the thermal conductive resin may include silicone.

In order to accomplish the above objects, the present invention provides an LED bulb including an LED module having a PCB on which at least one LED element is mounted, a housing having a plurality of heat dissipating protrusions which protrude from an outer circumferential surface thereof, with a thread being formed on a predetermined portion of the housing, a light transmitting cover having a thread by which the cover can be fastened to the thread which is formed on the predetermined portion of the housing, in a threaded manner, a bottom case into which an inverter for supplying a direct current to the LED module is inserted, a space of the bottom case except for an area having the inverter being molded with a thermal conductive resin, the bottom case being inserted into the housing to be fastened to the housing, and a socket fastened to the bottom case, wherein the plurality of heat dissipating protrusions are radially arranged on the outer circumferential surface of the housing in such a way as to protrude in a direction perpendicular to an axial direction of the housing, each of the heat dissipating protrusions having a tapered shape.

Advantageous Effects

Therefore, the present invention provides an LED bulb, which is constructed so that a plurality of heat dissipating protrusions protrudes from the outer circumferential surface of a housing to increase the surface area of the housing, thus enabling the heat generated by an LED element to be effectively dissipated.

Further, the present invention provides an LED bulb, which is constructed so that a space defined in a bottom case of a housing is molded with a thermal conductive resin, thus improving the conductivity of heat generated from an LED element and easily transferring heat from the LED element to the housing, therefore enabling the heat emitted from the LED element to be easily dissipated to the outside.

Further, the present invention provides an LED bulb, in which a housing and a light transmitting cover are constructed to be fastened to each other in a rotary locking manner, thus allowing the housing and the light transmitting cover to be fastened to each other in a simple manner.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Hereinafter, the preferred embodiment of the present invention will be described in detail with reference to the accompanying drawings. The terminology or words used in the description and the claims of the present invention should not be interpreted as being limited merely to common or dictionary meanings. On the contrary, they should be interpreted based on the meanings and concepts of the invention in keeping with the scope of the invention on the basis of the principle that the inventor(s) can appropriately define the terms in order to most clearly describe the invention.

Therefore, it is to be understood by those skilled in the art that the form of the invention herein shown and described is to be taken as a preferred embodiment of the present invention and does not cover all spirits of the present invention and that all changes which fall within the meets and bounds of the claims, or the equivalence of such meets and bounds are intended to be embraced by the claims.

Figure 1:
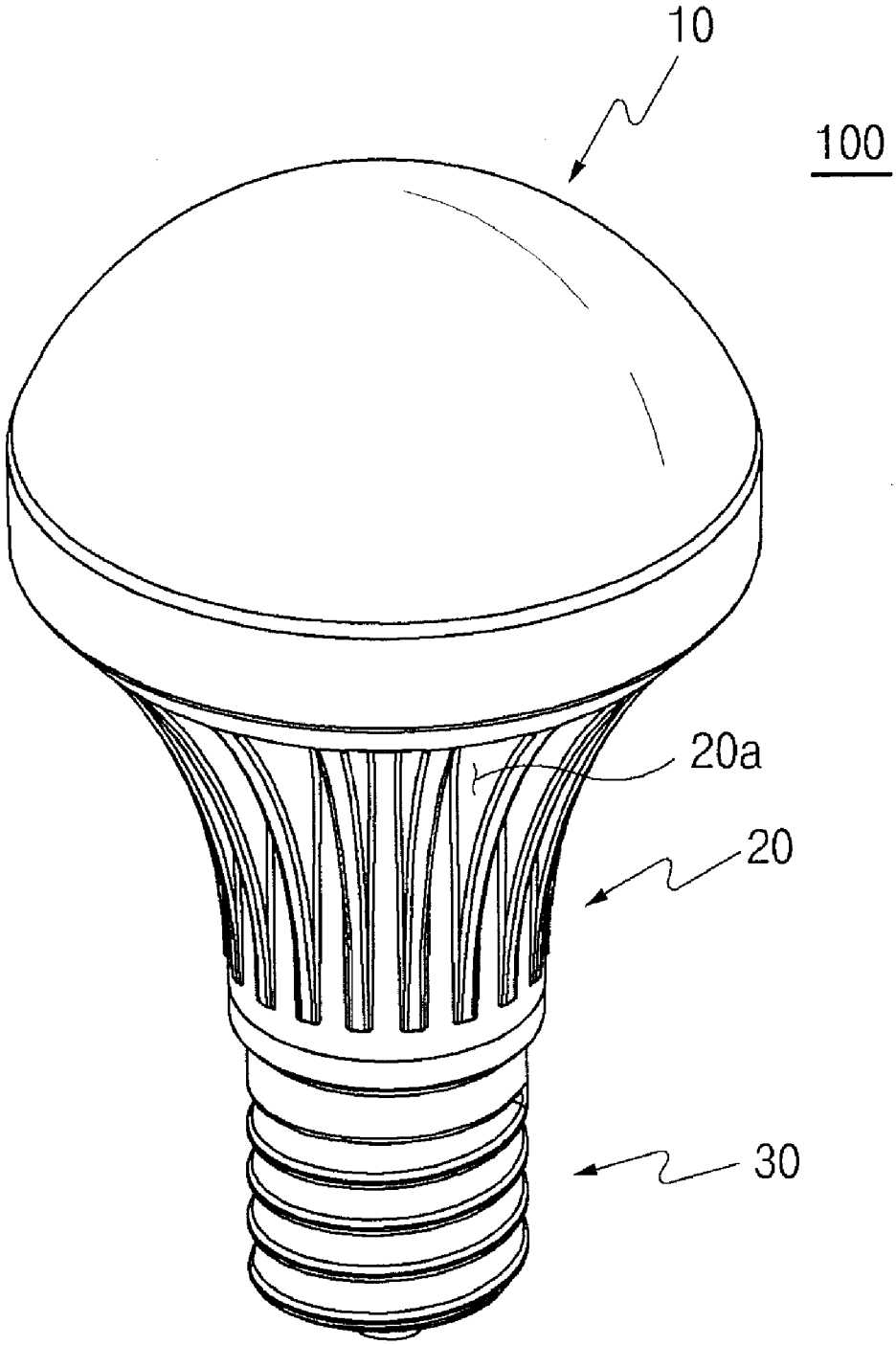
FIG. 1 is a perspective view showing an LED bulb according to an embodiment of the present invention.
Figure 2:
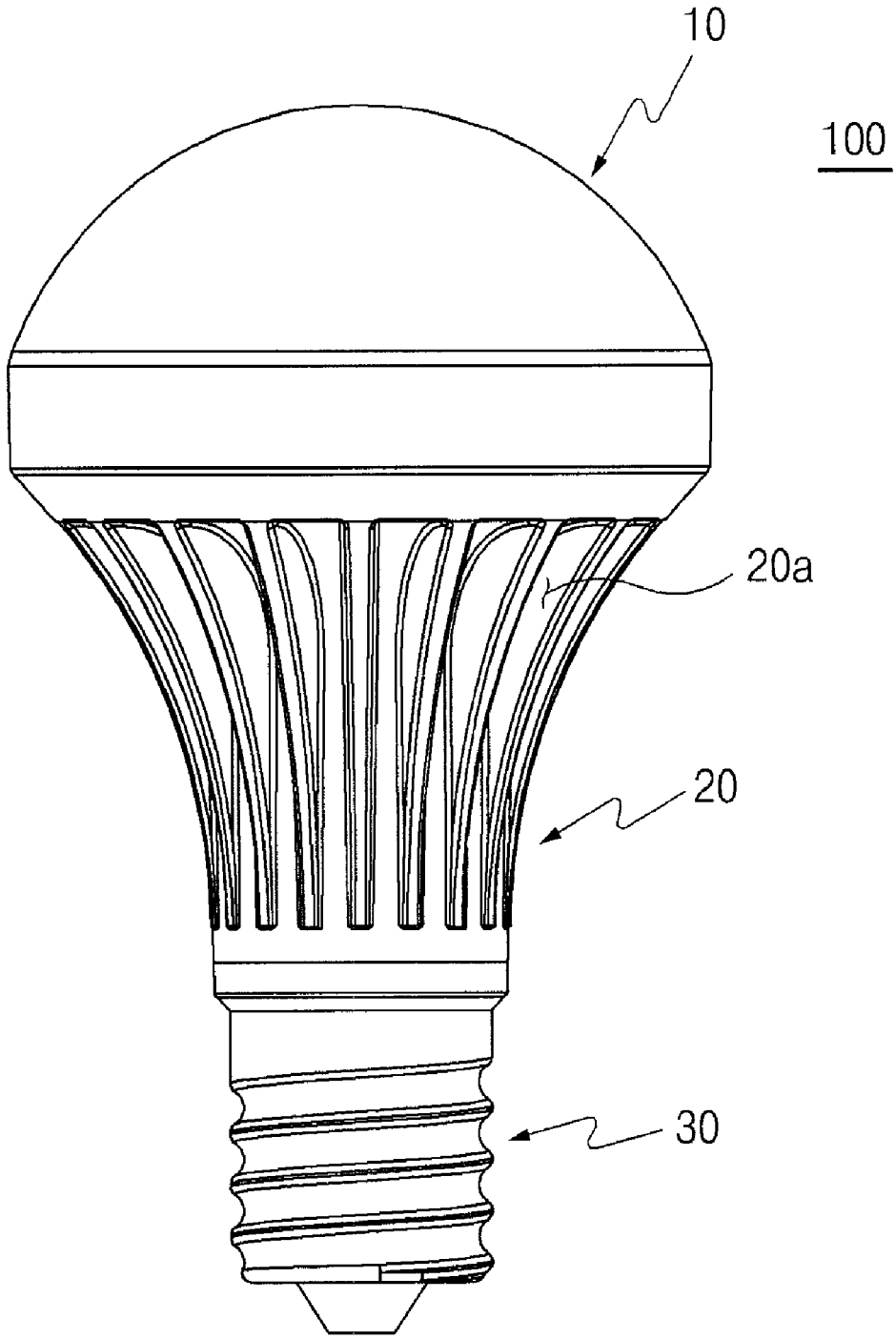
FIG. 2 is a front view showing the LED bulb according to the embodiment of the present invention.
Figure 3:
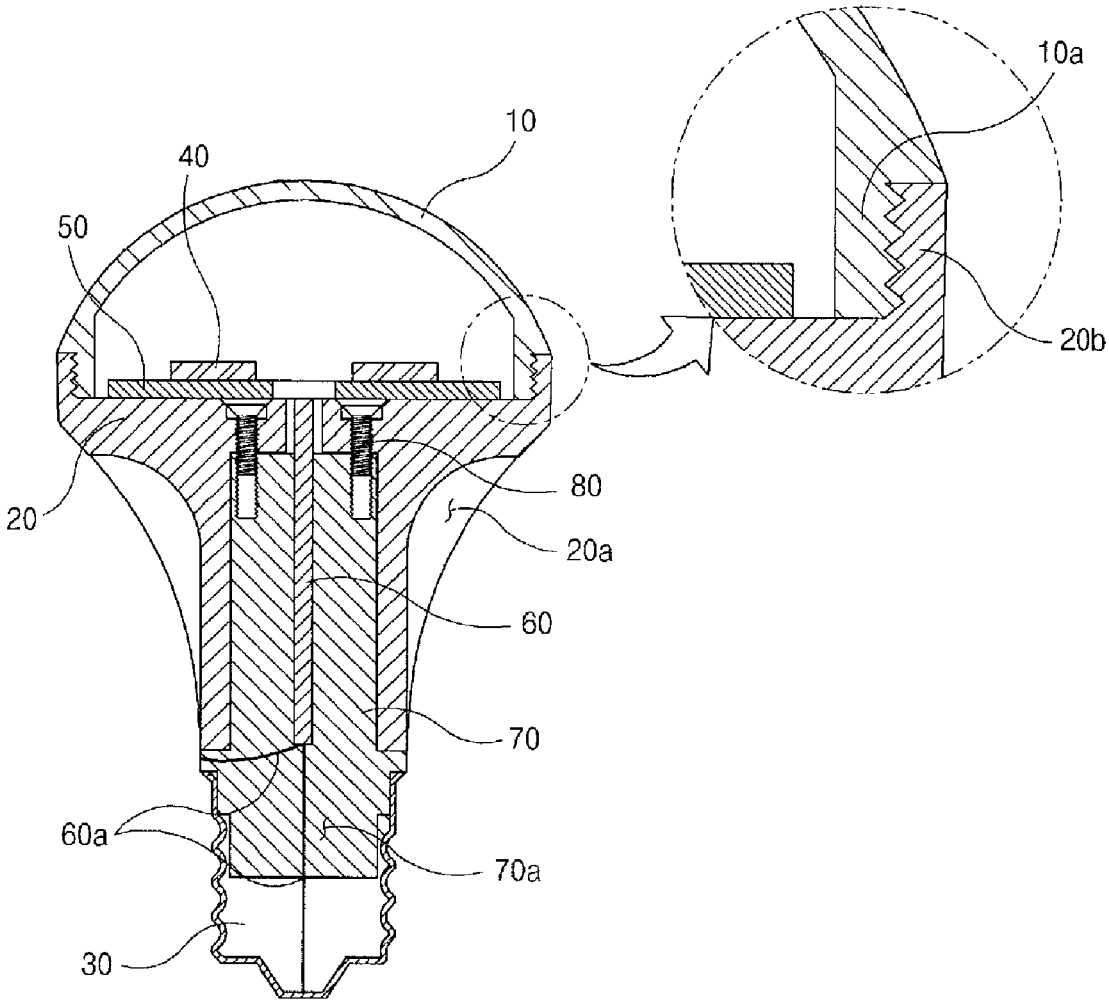
FIG. 3 is a sectional view showing the LED bulb according to the embodiment of the present invention.
Figure 4:
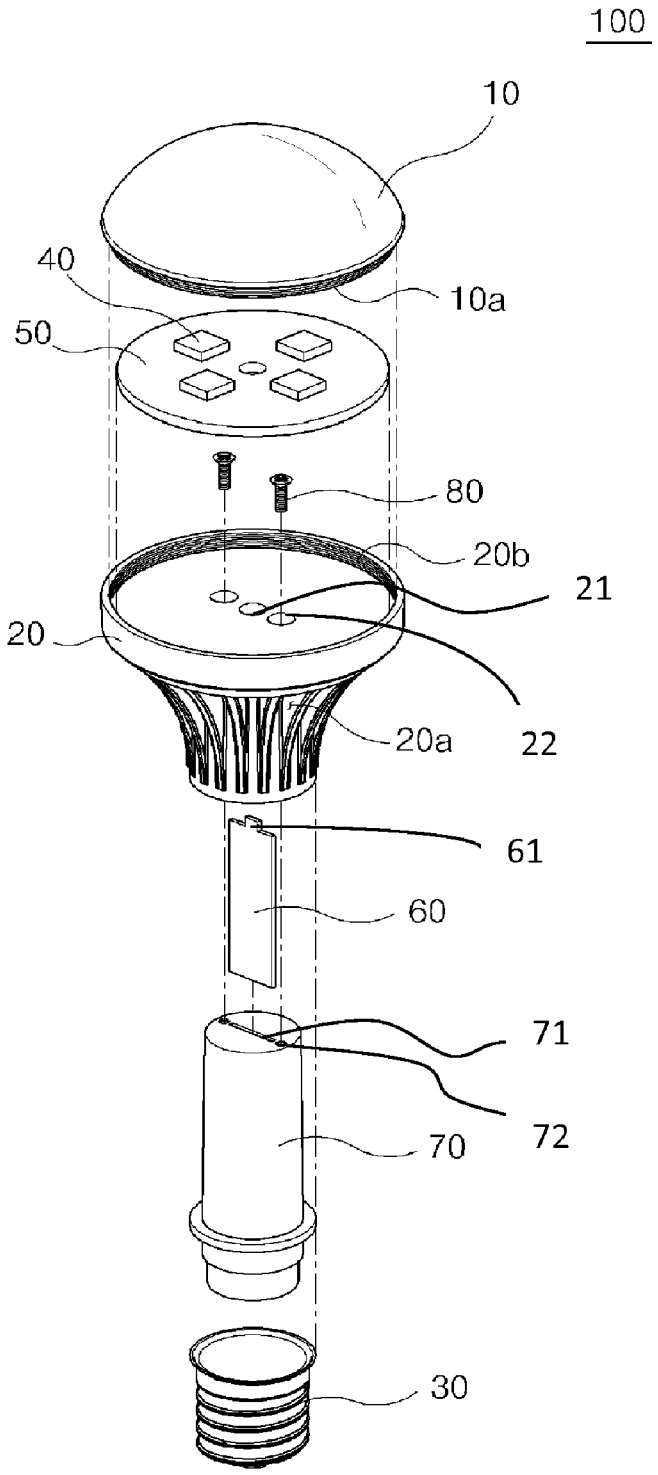
FIG. 4 is an exploded perspective view showing the LED bulb according to the embodiment of the present invention.
Figure 5:
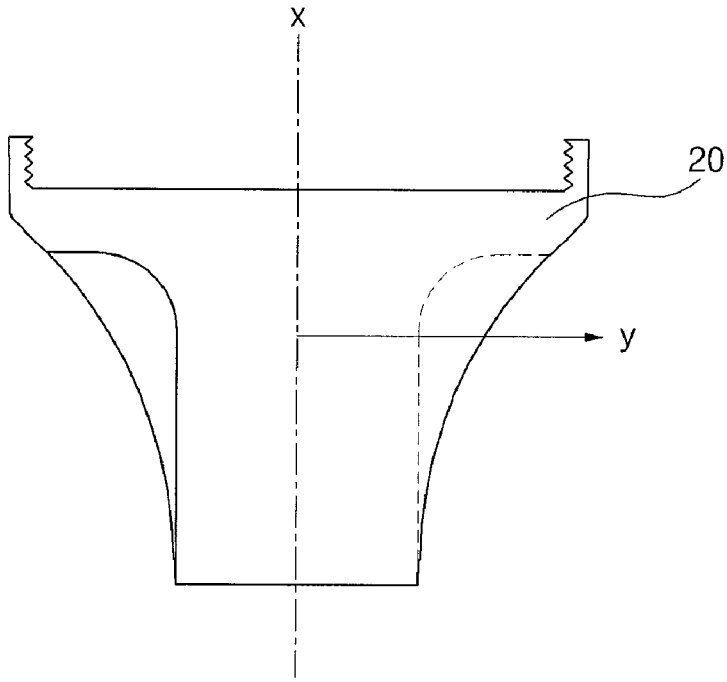
FIG. 5 is a sectional view illustrating the direction of heat dissipating protrusions formed on a housing that is shown in FIGS. 1 to 4.
Figure 6:
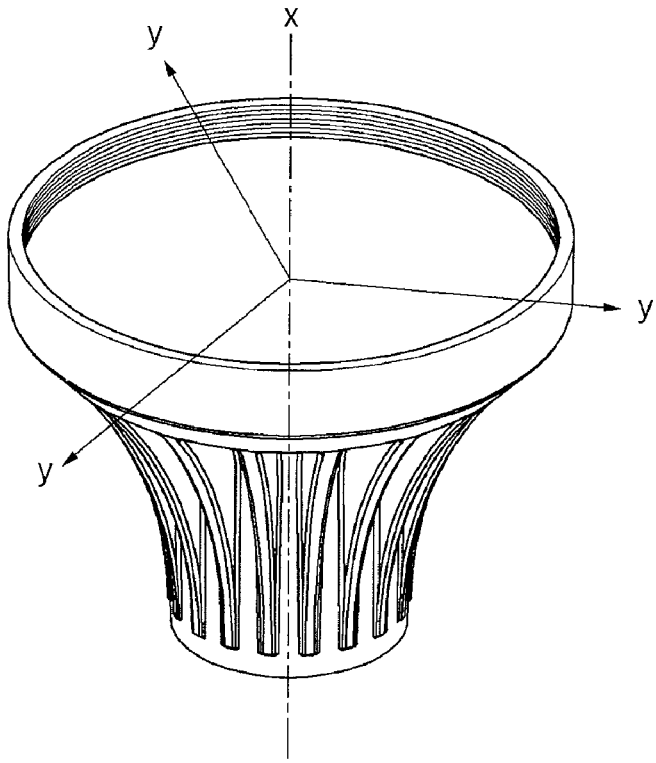
FIG. 6 is a perspective view illustrating the direction of the heat dissipating protrusions formed on the housing that is shown in FIGS. 1 to 4.
Figure 7:
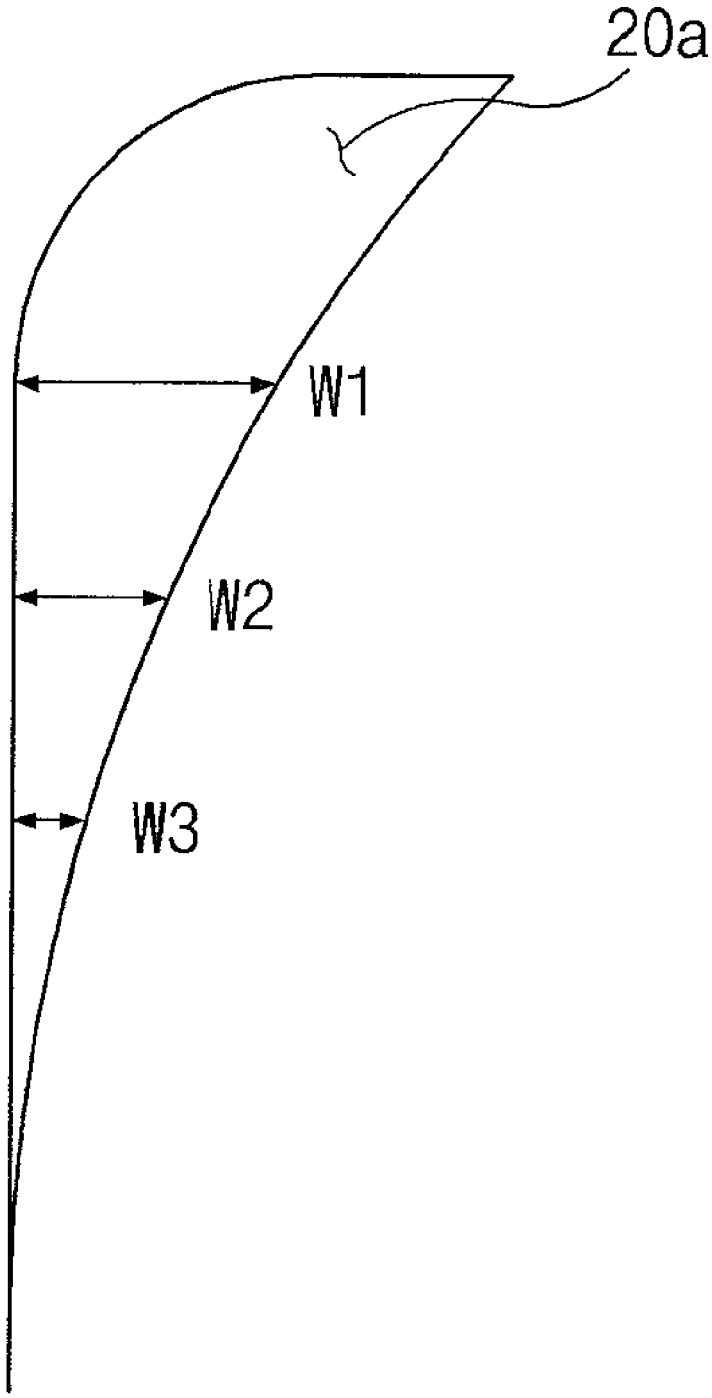
FIG. 7 is an enlarged view showing the heat dissipating protrusion according to the embodiment of the present invention.

FIG. 1 is a perspective view showing an LED bulb according to an embodiment of the present invention. FIG. 2 is a front view showing the LED bulb according to the embodiment of the present invention. FIG. 3 is a sectional view showing the LED bulb according to the embodiment of the present invention. FIG. 4 is an exploded perspective view showing the LED bulb according to the embodiment of the present invention. FIG. 5 is a sectional view illustrating the direction of heat dissipating protrusions formed on a housing that is shown in FIGS. 1 to 4. FIG. 6 is a perspective view illustrating the direction of the heat dissipating protrusions formed on the housing that is shown in FIGS. 1 to 4. FIG. 7 is an enlarged view showing the heat dissipating protrusion according to the embodiment of the present invention.

Referring to FIGS. 1 to 7, an LED bulb 100 of the present invention includes a light transmitting cover 10, a housing 20, and a socket 30.

The hemispherical light transmitting cover 10 and the housing 20 are fastened to each other in a rotary locking manner, namely, a threaded manner. To this end, threads 10*a* and 20*b* are formed, respectively, on predetermined portions of the light transmitting cover 10 and the housing 20 so that they are fastened to each other in a threaded manner. Thus, the light transmitting cover 10 and the housing 20 can be simply fastened to each other.

According to this embodiment, the light transmitting cover 10 has a hemispherical shape, but is not limited to the hemispherical shape. As long as only the area of the light transmitting cover 10 having the thread 10*a* to be fastened to the housing 20 has a circular shape, the light transmitting cover 10 may have any shape.

An LED module 50 is adhered to the housing 20 in such a way as to face the light transmitting cover 10, and includes a PCB on which a plurality of LED elements 40 is mounted.

The housing 20 includes a plurality of heat dissipating protrusions 20*a* which protrude from the outer circumferential surface of the housing 20. As shown in FIGS. 5 and 6, the heat dissipating protrusions 20*a* protrude from the outer circumferential surface of the housing 20 in a direction y perpendicular to an axial direction x, and are radially arranged. Here, the heat dissipating protrusions 20*a* may protrude integrally from the outer circumferential surface of the housing 20.

Further, each heat dissipating protrusion 20*a* is tapered such that its area increases in a direction from a lower portion to an upper portion of the housing 20. In detail, as shown in FIG. 7, the heat dissipating protrusion 20*a* is shaped such that its area is gradually increased in a direction from the lower portion of the housing 20, that is, a position W3 adjacent to the socket 30, through a position W2 adjacent to the middle portion of the housing 20, to the upper portion of the housing 20, that is, a position W1 adjacent to the LED module 50. Thus, as shown in FIG. 3, the housing 20 has the cross section in the shape of a trapezoid which is streamlined on its side surface.

The LED bulb 100 includes the plurality of heat dissipating protrusions 20*a* on the housing 20, thus enlarging the surface area of the housing 20. Especially, since the area of each heat dissipating protrusion 20*a* is increased towards a surface of the housing 20 to which the LED module 50 is adhered, namely, towards the upper portion of the housing 20, heat generated from the LED elements 40 can be dissipated as quickly as possible.

A step, which corresponds to the extent to which the heat dissipating protrusions 20*a* protrude, is formed on the housing 20. Further, the housing 20 may be made of at least one of aluminum and magnesium.

Further, the housing 20 has a space so that a bottom case 70 may be inserted into the housing 20. The housing 20 and the bottom case 70 inserted into the housing 20 are fastened to each other using fastening screws 80.

The bottom case 70 is connected to the socket 30 using electrode wires 60*a*, and an empty space of the bottom case 70 except for an area into which an inverter 60 is inserted is molded with a thermal conductive resin 70*a*. The inverter 60 is a device that converts an alternating current into a direct current, and converts the alternating current, which is input from the socket 30 through the electrode wires 60*a*, into direct current and then provides the direct current to the LED module 50.

The LED module 50 emits light from the LED elements 40 which are mounted on the PCB, using the current supplied from the inverter 60.

Further, as shown in FIG. 4, the housing 20 can include an inverter through-hole 21 into which an upper protrusion 61 of the inverter 60 is inserted, and two fastening screw holes 22 which are configured to fasten the housing 20 to the bottom case 70 using the fastening screws 80. The bottom case 70 has an inverter groove 71 into which the inverter 60 is inserted, and two fastening screw grooves 72 configured to fasten the bottom 70 case to the housing 20 using the fastening screws 80. As such, the lower part of the inverter 70 slides and is inserted into the inverter groove 71 of the bottom case 70, the upper protrusion 61 of the inverter 60 being inserted into the inverter through-hole 21 of the housing 20, and therefore the inverter 60 is placed in the inverter groove 71 of the bottom case 70, being held by the groove 71 of the bottom case 70 and the inverter through-hole 21 of the housing 20, as shown in FIGS. 3 and 4.

Further, the reason why the empty space of the bottom case 70 is molded with the thermal conductive resin 70*a* is because the heat conductivity in the bottom case 70 is increased and thus heat emitted from the LED elements 40 is rapidly transferred to the inner circumference of the housing 20.

Therefore, the LED bulb 100 prevents heat emitted from the LED elements 40 from staying in the housing 20 for a long period of time, and allows the heat to be easily dissipated through the housing 20 to the outside. Here, the thermal conductive resin 70*a* may use a resin such as silicone.

According to the present invention, each heat dissipating protrusion 20*a* has a tapered shape, but is not limited to the tapered shape. That is, the heat dissipating protrusion 20*a* may have the shape of a streamlined wedge or a right-angled triangular wedge. As such, the shape of the heat dissipating protrusion 20*a* may be freely changed depending on the shape of the housing 200.

Further, according to the present invention, the heat dissipating protrusion 20*a* protrudes integrally from the outer circumferential surface of the housing 20, but is not limited to the shape. That is, after a plurality of heat dissipating protrusions 20*a* is separately manufactured, the heat dissipating protrusions 20*a* may be adhered to the outer circumferential surface of the housing 20.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A LED bulb, comprising:

a LED module having a PCB on which at least one LED element is mounted; a housing having on a predetermined portion thereof a thread, and integrated with a plurality of heat dissipating protrusions which protrude from an outer circumferential surface thereof, an inverter through-hole into which an upper protrusion of an inverter is inserted, and a fastening screw hole which is configured to fasten the housing to a bottom case using a fastening screw;

a light transmitting cover having a thread by which the cover can be fastened to the corresponding thread which is formed on the predetermined portion of the housing, in a threaded manner;

the bottom case into which the inverter, for supplying a direct current to the LED module, is inserted, the bottom case being inserted into the housing to be fastened to the housing;

a thermal conductive resin comprising silicone and molded in an internal space of the bottom case except for an area into which the inverter is inserted; and a socket into which the bottom case is inserted and which is fastened to the bottom case, wherein the light transmitting cover is hemisphere, wherein the bottom case has an inverter groove into which the inverter is inserted, and a fastening screw groove configured to fasten the bottom case to the housing the fastening screw, and wherein the lower part of the inverter slides and is inserted into the inverter groove of the bottom case, the upper protrusion of the inverter being inserted into the inverter through-hole of the housing, such that the inverter is placed in the inverter groove of the bottom case, being held by the inverter groove of the bottom case and the inverter through-hole of the housing.

2. The LED bulb as set forth in claim 1, wherein the plurality of heat dissipating protrusions are radially arranged on the outer circumferential surface of the housing in such a way as to protrude in a direction perpendicular to an axial direction of the housing.

3. The LED bulb as set forth in claim 2, wherein each of the heat dissipating protrusions is tapered such that an area thereof increases in a direction from a lower portion to an upper portion of the housing.

4. The LED bulb as set forth in claim 1, wherein the inverter is connected to the socket via an electrode wire, and converts an alternating current, which is input from an outside through the socket, into a direct current, thus providing the direct current to the LED module.

5. The LED bulb as set forth in claim 3, wherein the housing is made of at least one of aluminum and magnesium.

* * * * *